US008042611B2

(12) United States Patent
Briquet et al.

(10) Patent No.: US 8,042,611 B2
(45) Date of Patent: Oct. 25, 2011

(54) FIELD JOINT FOR A DOWNHOLE TOOL

(75) Inventors: Stephane Briquet, Houston, TX (US); Steve Ervin, Sugar Land, TX (US); Kevin Hayes, Missouri City, TX (US); Chris Del Campo, Houston, TX (US); Joe Nahas, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/762,709

(22) Filed: Apr. 19, 2010

(65) Prior Publication Data

US 2010/0200212 A1 Aug. 12, 2010

Related U.S. Application Data

(63) Continuation of application No. 11/829,198, filed on Jul. 27, 2007, now Pat. No. 7,726,396.

(51) Int. Cl.
*E21B 17/02* (2006.01)

(52) U.S. Cl. ..... 166/242.6; 166/264

(58) Field of Classification Search ..... 166/65.1, 166/100, 242.6, 264; 439/191; 403/34, 408.1
See application file for complete search history.

(56) References Cited

U.S. PATENT DOCUMENTS

| | | | |
|---|---|---|---|
| 3,430,181 | A | 2/1969 | Urbanosky |
| 3,831,443 | A | 8/1974 | Planche |
| 3,934,468 | A | 1/1976 | Brieger |
| 4,690,212 | A | 9/1987 | Termohlen |
| 4,708,201 | A | 11/1987 | Reed |
| 4,860,581 | A | 8/1989 | Zimmerman et al. |
| 4,893,505 | A | 1/1990 | Marsden et al. |
| 4,936,139 | A | 6/1990 | Zimmerman et al. |
| 5,033,808 | A | 7/1991 | Smith et al. |
| 5,159,978 | A | 11/1992 | Tomek et al. |
| 5,303,773 | A | 4/1994 | Czernichow et al. |
| 5,358,418 | A | 10/1994 | Carmichael |
| 5,377,747 | A | 1/1995 | Didier |
| 5,622,223 | A | 4/1997 | Vasquez |
| 6,116,337 | A | 9/2000 | Civarolo et al. |
| 6,298,917 | B1 | 10/2001 | Kobylinski et al. |
| 6,301,959 | B1 | 10/2001 | Hrametz et al. |
| 6,484,801 | B2 | 11/2002 | Brewer et al. |
| 6,561,268 | B2 | 5/2003 | Jones |
| 6,582,251 | B1 | 6/2003 | Burke et al. |
| 6,688,386 | B2 | 2/2004 | Cornelssen et al. |
| 6,780,037 | B1 | 8/2004 | Parmeter et al. |

(Continued)

FOREIGN PATENT DOCUMENTS

| | | |
|---|---|---|
| EP | 0302632 | 7/1989 |

*Primary Examiner* — Jennifer H Gay
*Assistant Examiner* — Blake Michener

(57) ABSTRACT

A field joint for connecting a plurality of downhole tool modules is disclosed. The modules include a housing and an electrical line. A bulkhead is coupled to a first module that includes a first conduit aperture for receiving an electrical connector assembly. The first electrical connector assembly is releasably coupled to the exterior portion of the first module and includes a first connector having a first end adapted for electrical coupling to an electrical line. A connector block is coupled to the second module that includes a second conduit aperture positioned to substantially face the first conduit aperture when the first and second modules are joined. A second electrical connector is disposed in the second conduit aperture and is electrically coupled to an electrical line such that an electrical contact is established with a second end of the first connector when the first and second modules are joined.

4 Claims, 7 Drawing Sheets

U.S. PATENT DOCUMENTS

| | | | |
|---|---|---|---|
| 7,140,436 | B2 | 11/2006 | Grant et al. |
| 7,191,828 | B2 | 3/2007 | Arizmendi et al. |
| 7,191,831 | B2 | 3/2007 | Reid et al. |
| 7,325,596 | B2 | 2/2008 | Ebner |
| 7,527,105 | B2 | 5/2009 | Hall et al. |
| 2005/0186823 | A1 | 8/2005 | Ring et al. |
| 2006/0000599 | A1 | 1/2006 | Biester |
| 2006/0283606 | A1 | 12/2006 | Partouche et al. |
| 2009/0090517 | A1 | 4/2009 | Jackson et al. |
| 2009/0229817 | A1 | 9/2009 | Partouche |

FIELD JOINT FOR A DOWNHOLE TOOL

CROSS REFERENCE TO RELATED APPLICATIONS

This application is a continuation of U.S. patent application Ser. No. 11/829,198, filed Jul. 27, 2007 now U.S. Pat. No. 7,726,396, which is hereby incorporated by reference in its entirety.

BACKGROUND

1. Technical Field

This disclosure generally relates to oil and gas well drilling and the subsequent investigation of subterranean formations surrounding the well. More particularly, this disclosure relates to "field joints," which are connections for transferring auxiliary fluids and electronic signals/power between components of a downhole tool.

2. Description of the Related Art

Wells are generally drilled into the ground or ocean bed to recover natural deposits of oil and gas, as well as other desirable materials that are trapped in geological formations in the Earth's crust. A well is drilled into the ground and directed to the targeted geological location from a drilling rig at the Earth's surface. The well may be formed using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the wellbore wall.

For successful oil and gas exploration, it is advantageous to have information about the subsurface formations that are penetrated by a wellbore. For example, one aspect of standard formation testing relates to the measurements of the formation pressure and formation permeability. Another aspect of standard formation resting relates to the extraction of formation fluid for fluid characterization, in situ or in surface laboratories. These measurements are useful to predicting the production capacity and production lifetime of a subsurface formation.

One technique for measuring formation and fluid properties includes lowering a "wireline" tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include one or more probe and/or one or more inflatable packer that may be pressed against the wellbore wall to establish fluid communication with the formation. This type of wireline tool is often called a "formation testing tool." Using the probe, a formation testing tool measures the pressure of the formation fluids and generates a pressure pulse, which is used to determine the formation permeability. The formation testing tool may also withdraw a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a "trip" uphole. Further, the wireline tools must be lowered to the zone of interest, generally at or near the bottom of the hole. The combination of removing the drill string and lowering the wireline tool downhole is time-consuming and can take up to several hours, depending on the depth of the wellbore. Because of the great expense and rig time required to "trip" the drill pipe and lower the wireline tool down the wellbore, wireline tools are generally used when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling). A variety of downhole MWD and LWD drilling tools are commercially available.

MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms. Furthermore, LWD and MWD are not necessarily performed while the drill bit is actually cutting through the formation. For example, LWD and MWD may occur during interruptions in the drilling process, such as when the drill bit is briefly stopped to take measurements, after which drilling resumes. Measurements taken during intermittent breaks in drilling are still considered to be made "while-drilling" because they do not require the drill string to be tripped.

Formation evaluation, whether during a wireline operation or while drilling, often requires that fluid from the formation be drawn into a downhole tool for testing and/or sampling. Various sampling devices, typically referred to as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device that may be used to form a seal with the wellbore sidewall is an inflatable packer. The inflatable packer may be used in a paired configuration that includes two elastomeric rings that radially expand about the tool to isolate a portion of the wellbore therebetween. The rings form a seal with the wellbore wall and permit fluid to be drawn into the isolated portion of the wellbore and into an inlet in the downhole tool.

The various drilling tools and wireline tools, as well as other wellbore tools conveyed on coiled tubing, drill pipe, casing, or other conveyors, are also referred to herein simply as "downhole tools." Such downhole tools may themselves include a plurality of integrated modules, each for performing a separate function or set of functions, and a downhole tool may be employed alone or in combination with other downhole tools in a downhole tool string.

Modular downhole tools typically include several different types of modules. Each module may perform one or more functions, such as electrical power supply, hydraulic power supply, fluid sampling, fluid analysis, and sample collection. Such modules are depicted, for example, in U.S. Pat. Nos.

4,860,581 and 4,936,139. Accordingly, a fluid analysis module may analyze formation fluid drawn into the downhole tool for testing and/or sampling. This and other types of downhole fluid (other than drilling mud pumped through a drill string) are referred to herein as "auxiliary fluid." This auxiliary fluid may be transferred between modules of an integrated tool and/or between tools interconnected in a tool string. In addition, electrical power and/or electronic signals (e.g., for data transmission) may also be transferred between modules of such tools. Example of field joints interconnecting tools in a tool string can be found in U.S. Pat. No. 7,191,831, and U.S. Patent App. Pub. No. 2006/0283606, both assigned to the same assignee of the present invention and included herein by reference. Another example of connector can be found in U.S. Pat. No. 6,582,251.

A common issue with field joints used between adjacent modules is contamination of the electrical connection by fluid. Fluid contamination is particularly common when the field joints are broken for transport or reconfiguration after downhole use. Auxiliary fluid and mud may still reside in the internal flow lines which, when the field joint is broken, may leak over the exposed end faces of the modules. Also, rain, sea water (in the case of offshore operations) may contaminate the connection the field joint is open on the rig floor. Electrical pins and sockets can become contaminated by the fluid thereby impairing the ability of these components to conduct electricity. Wear-out, contamination of electrical connectors, etc may be so severe that replacement is needed, which typically requires the tool or module to be opened, thereby exposing the internal tool components to the surrounding environment. Additionally, the fluid and electrical connection layout of conventional field joints allows for only a limited number of fluid and electrical connections, thereby limiting the types of modules that may be used in a downhole tool.

SUMMARY OF THE DISCLOSURE

In accordance with one embodiment of the disclosure, a field joint for connecting downhole tool modules includes housings and electrical lines disposed therein. The field joint includes a bulkhead that is coupled to a first tool module and includes a first connection face defining a portion of an exterior of the first tool module. The first connection face further includes a first conduit aperture that is configured for receiving an electrical connector assembly. A first electrical connector assembly includes a first connector having a first end adapted for electrical coupling to the first electrical lines and a second end that receives the first conduit aperture—the assembly being releasably coupled to the exterior portion of the first tool module. A connector block is coupled to the second tool module and has a second connection face defining a second conduit aperture positioned to substantially face the first conduit aperture when the first and second tool modules are joined. A second electrical connector is disposed in the second conduit aperture and is electrically coupled to the second electrical line and is configured for establishing an electrical contact with the second end of the first connector when the first and second tool modules are joined.

In accordance with another embodiment of the disclosure, a field joint for connecting downhole tool modules includes housings and electrical lines disposed therein. The field joint includes a bulkhead coupled to the first housing that has a first connection face that defines a central region having a plurality of first fluid connectors and a peripheral region surrounding the central region that includes a first conduit aperture. A first electrical connector assembly is coupled to the first conduit aperture, and includes a first connector having a first end adapted for electrical coupling to the first electrical line and a second end. A connector block is coupled to the second housing and includes a second connection face that defines at least one central hole that is sized for receiving a plurality of second fluid connectors being positioned to fluidly couple with the first fluid connectors of the first connection face and a peripheral region surrounding the at least one central hole that includes a second conduit aperture positioned to substantially face the first conduit aperture when the first and second tool modules are joined. A second electrical connector is disposed in the second conduit aperture and is the second electrical connector being electrically coupled to the second electrical line and configured for electrical coupling to the second end of the first electrical connector.

In accordance with another embodiment of the disclosure, a field joint for connecting downhole tool modules includes housings and electrical lines disposed therein. The field joint includes a bulkhead coupled to the first housing and has a first connection face that includes a first conduit aperture for receiving an electrical connector assembly. A first electrical connector assembly is received in the first conduit aperture and includes a first connector having a first end adapted for electrical coupling to the first electrical lines and having a second end. A first connector block is releasably coupled to the second housing and having a second connection face that includes a second conduit aperture positioned to substantially face the first conduit aperture when the first and second tool modules are joined. A second electrical connector electrically couples with the second end of the first electrical connector disposed in the second conduit aperture and is electrically coupled to the second electrical line.

In accordance with another embodiment of the disclosure, a downhole tool includes a plurality of modules and is positionable in a wellbore penetrating a subterranean formation. The tool includes a first module, a second module, a third module and a connector. The first module includes at least one inlet for receiving formation fluid that is coupled to a first auxiliary line. The formation fluid is drawn into the tool by a displacement system operatively coupled to the first auxiliary line. The second module includes a hydraulic pump that is fluidly connected to the displacement system via at least two hydraulic lines, and the third module includes an electrical controller communicably coupled to a plurality of electrical lines that are communicably coupled to each of the first and second modules. The connector is disposed between at least two of the modules and includes at least two hydraulic line connections and two auxiliary line connections.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

This disclosure describes a connector and system that allows fluid as well as electrical signals to be transferred between nearby tools or modules while maintaining standard drilling or evaluation operations. This apparatus allows two downhole tools or tool modules to be connected for fluid (hydraulic) and electrical communication therebetween. The connector is adaptable for placement anywhere on a downhole tool string where such communication is needed.

As used herein, the term "auxiliary fluid" means a downhole fluid (other than drilling mud pumped through a drill string), such as formation fluid that is typically drawn into the downhole tool for testing and/or sampling, specialty fluids (e.g., workover fluids) for injection into a subsurface formation, wellbore fluid for inflating packers amongst other things. Typically, but not necessarily, the auxiliary fluid has utility in a downhole operation other than actuating moving components of the downhole tool or cooling component of the downhole tool.

"Electrical" and "electrically" refer to connection(s) and/or line(s) for transmitting electronic signals. "Electronic signals" mean signals that are capable of transmitting electrical power and/or data (e.g., binary data).

In this disclosure, the term "module" is used to describe any of the separate tools or individual tool modules that may be connected in a downhole tool. "Module" describes any part of the downhole tool, whether the module is part of a larger tool or a separate tool by itself.

"Modular" means adapted for (inter)connecting modules and/or tools, and possibly constructed with standardized units or dimensions for flexibility and variety in use.

Figure 1:
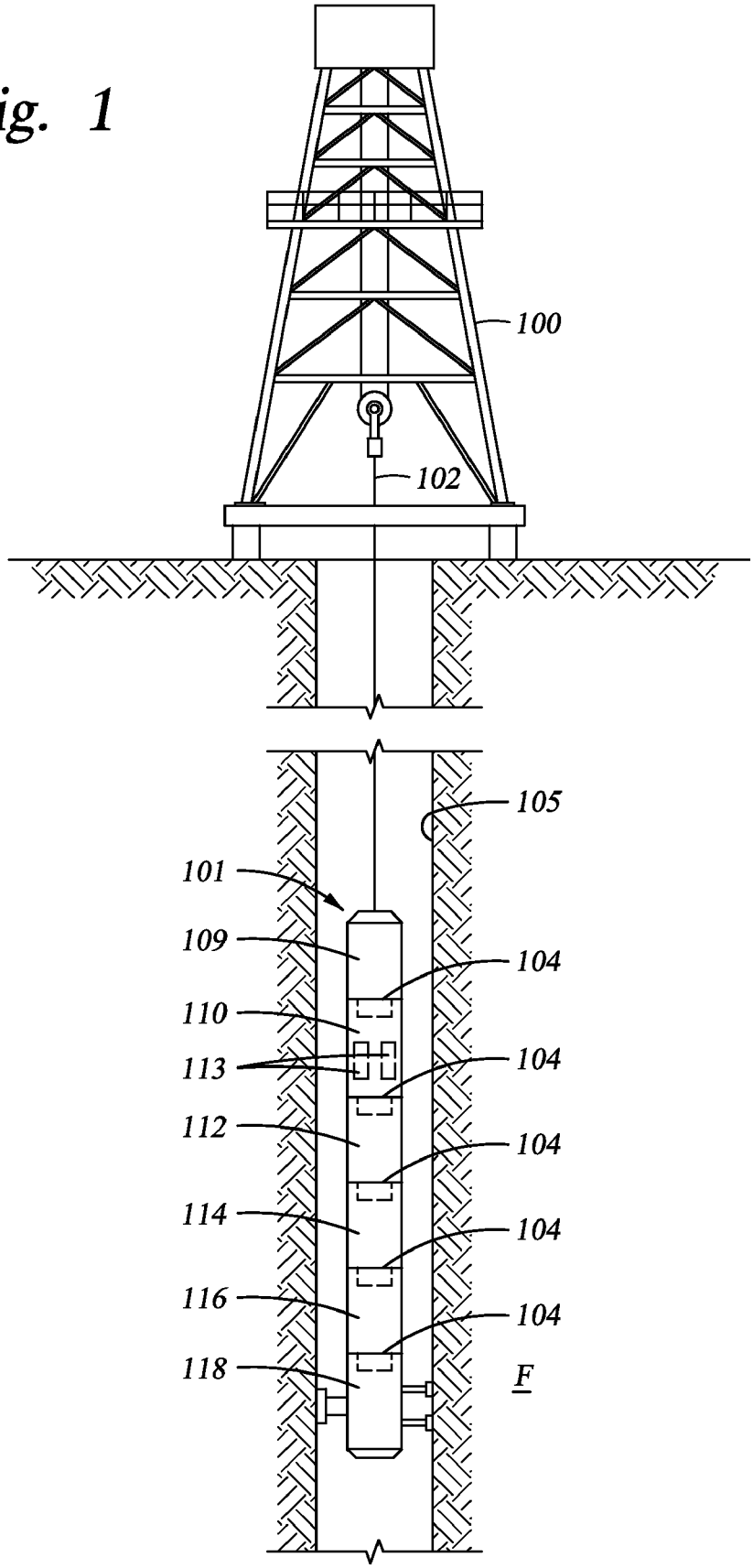
FIG. 1 is a schematic of a wireline assembly that includes field joints according to the present disclosure.

FIG. 1 shows a schematic of a wireline apparatus 101 deployed from a rig 100 into a wellbore 105 traversing a reservoir or geological formation F, according to one embodiment of the present disclosure. Alternatively the tool may be directly deployed from a truck without utilizing the rig. The wireline apparatus 101 may be lowered into the wellbore 105 using a wireline cable 102, as is well known in the art. Wellbore diameter varies usually from 6.0 inches to 8.5 inches in reservoirs, and sometimes more in shallow sedimentary layers. Therefore, the diameter of the wireline apparatus 101 is usually limited below 5.25 inches, for example about of 4.75 inches. Apparatuses of larger diameter exist, but are limited to operations in wells having a large wellbore diameter. The wireline apparatus 101 includes several modules connected by field joints 104, that have similar size restrictions as the wireline tool. In the illustrated embodiment, the wireline apparatus 101 includes an electronics module 109, a sample storage module 110, a first pump out module 112, a second pump out module 114, a hydraulic module 116, and a probe module 118. The wireline apparatus 101 may include any number of modules, including less than and more than the six modules shown in the illustrated embodiments, and may incorporate different types of modules for performing different functions than those described above. Field joints 104 are provided between each adjacent pair of modules for reliably connecting the fluid and electrical lines extending through the apparatus 101.

Figure 2:
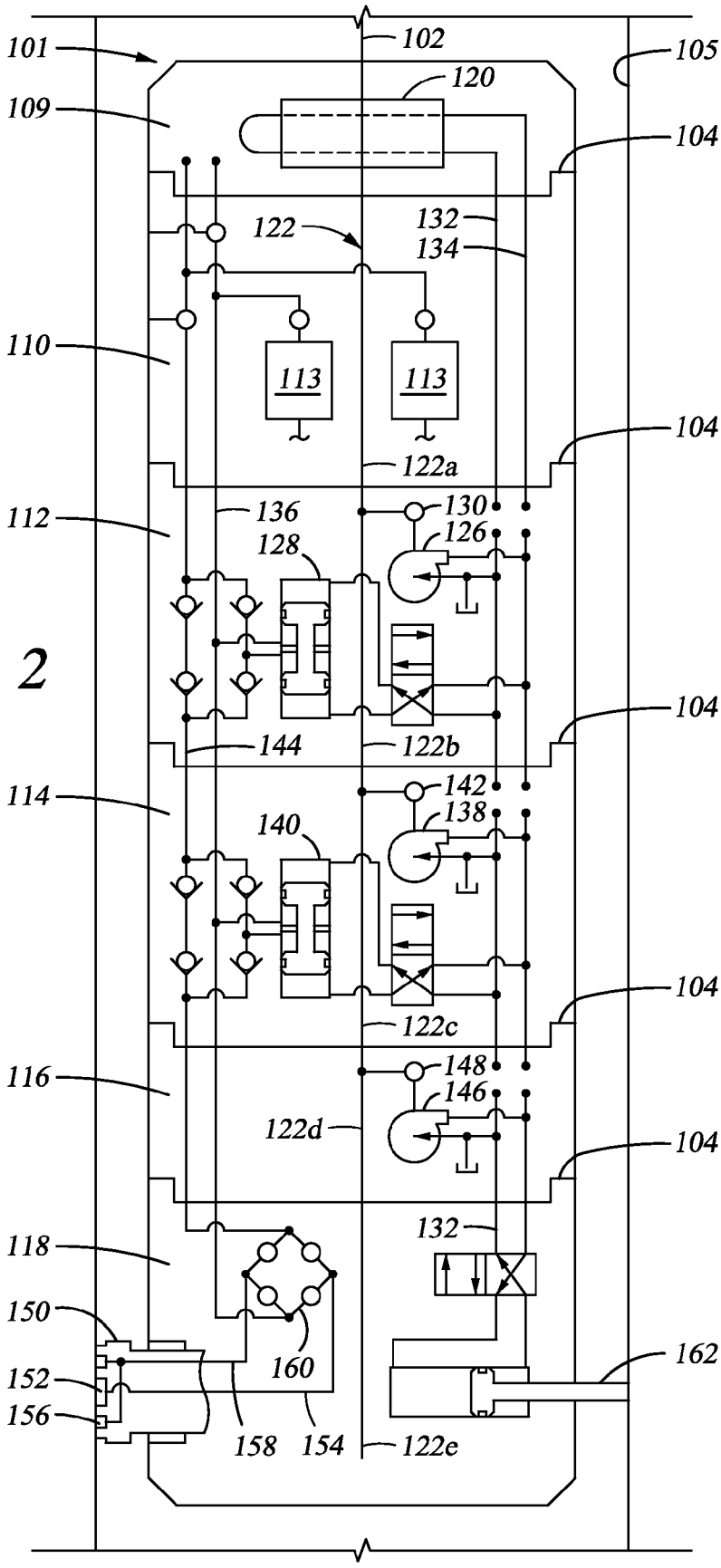
FIG. 2 is an enlarged schematic of the wireline tool shown in FIG. 1.

As shown in greater detail in FIG. 2, the electronics module 109 includes an electronics controller 120 operatively coupled to the wireline cable 102. An electrical line 122 is coupled to an interface of the controller 120 and includes segments 122*a*-122*e* that extend through each of the tool modules. Electrical line 122 transmits electronic signals, which may include the transmission of electrical power and/or data. The sample module 110 includes sample chambers 113 for storing fluid samples.

The first and second pump out modules 112, 114 are provided for controlling through first and second formation fluid flow lines 136, 144, respectively. The first pump out module 112 includes a pump 126 and a displacement unit 128. A motor 130 is operatively coupled to the pump 126. The pump 126 and displacement unit 128 are fluidly coupled to a hydraulic power line 132 and a hydraulic return line 134. The displacement unit 128 is also fluidly coupled to the first formation fluid flow line 136. The second pump out module 114 similarly includes a pump 138 and a displacement unit 140, with a motor 142 operatively coupled to the pump 138. The pump 138 and displacement unit 140 are fluidly coupled to the hydraulic power line 132 and hydraulic return line 134. The displacement unit 140 is also fluidly coupled to a second formation fluid flow line 144.

The hydraulic module 116 controls the flow of hydraulic fluid through hydraulic fluid lines. The module 116 includes a pump 146 fluidly coupled to the hydraulic power line 132 and the hydraulic return line 134. A motor 148 is operatively coupled to the pump 146.

The probe module 118 provides structure for obtaining fluid samples from the formation. The probe module 118 includes a probe assembly 150 having a sample inlet 152 fluidly coupled to a sample line 154 and a guard inlet 156 fluidly coupled to a guard line 158. The sample line 154 and guard line 158 are fluidly coupled to a bypass valve system 160 which in turn is fluidly coupled to the first and second formation fluid flow lines 136, 144. The illustrated probe module 118 also includes a setting piston 162 which is operably coupled to the hydraulic power line 132 and hydraulic return line 134. The bypass system 160 is shown as part of the probe module 118, but the bypass module 160 may be implemented as a module which can be placed anywhere in the tool string and/or duplicated. A bypass system module contributes, together with the field joint of this disclosure, to a new adaptability of the downhole testing tool.

Not shown on FIG. 2 is a sensor module having one or more sensor for measuring a fluid property (pressure, flow rate, resistivity, optical transmission or reflection, fluorescence, nuclear magnetic resonance, density, viscosity are amongst the most used). One or more sensor module, together with a bypass module mentioned above and the connector of this disclosure contributes to a whole range of new applications of the downhole testing tool.

As illustrated in FIG. 2, each tool module includes fluid and electrical lines that are connected when the modular wireline tool 101 is assembled. The illustrated embodiment includes four separate fluid lines, namely the first formation fluid flow line 136, the second formation fluid flow line 144, the hydraulic power line 132, and the hydraulic return line 134. Additionally, the electrical line 122 extends through each module.

While the electrical line 122 is illustrated in FIG. 2 with a single line, the tool 101 may include multiple separate electrical wires or lines, each of which may have a separate function and may carry different voltages or amperages. Additionally or alternatively, multiple redundant electrical lines may be provided to perform the same function. When multiple electrical lines are provided, there are multiple electrical connections that must be made between tool modules. Consequently, the connection interfaces or field joints 104 must reliably connect the segments of various fluid flow and electrical lines. Additionally, it is important to isolate the electrical connections from one another and from the fluid lines to prevent inadvertent shorts, and to minimize or prevent fluid from contaminating the electrical connections.

Figure 3:
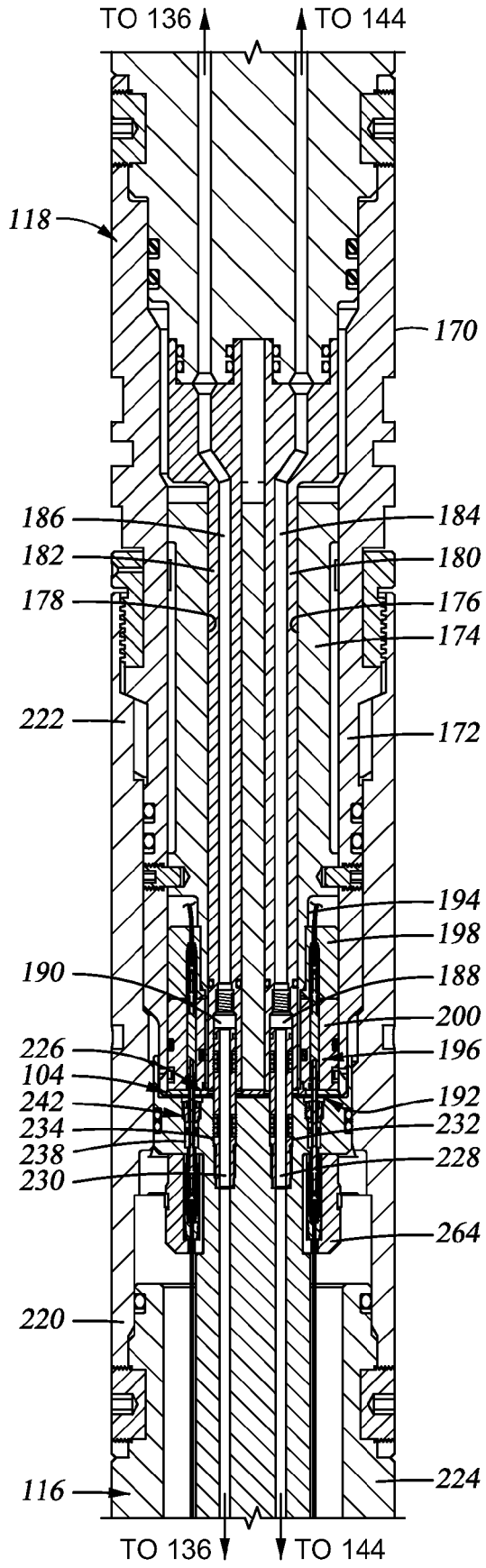
FIG. 3 is a cross-sectional view of two tool modules connected at a field joint.

An exemplary field joint 104 connecting adjacent tool modules, such as the hydraulic module 116 and the probe module 118, is illustrated in greater detail in FIG. 3. The probe module 118 includes an outer housing 170 having a male connection end 172. A transition block 174 is coupled to the housing 170 and includes fluid flow line apertures 176, 178 sized to receive flow line conduits 180, 182. The flow line conduits 180, 182 define first and second fluid flow lines 184, 186 for transporting fluids used in the tool. In the illustrated embodiment, the first and second fluid conduits 180, 182 are formed of high strength, high corrosion resistance alloy, such as a nickel based alloy (Inconel® 718, or Hastelloy® C276), a titanium based alloy, or MP35N® for example. The fluid conduits 180, 182 further define first and second receptacles 188, 190 located near a connection face 192 of the module 118. Note that in the cross section shown in FIG. 2, only two flow lines are visible. However, the other two flow lines (not shown) are located in front of and behind the section plane. For example, the flow line 186 may be fluidly connected to the flow line 136, and the flow line 184 may be fluidly connected to the flow line 144.

The transition block 174 further includes an outer recess 194 formed near the connection face 192 for receiving components of an electrical connector assembly. More specifically, and as best shown with reference to FIG. 4, a female electrical connector assembly 196 includes a stationary connector block 198 and a removable connector block 200 positioned adjacent to the stationary block 198. Both blocks are formed of a non conductive polymer. The stationery block 198 includes at least one aperture for receiving an electrical terminal such as a wire crimp 202 for securely engaging at least one end of the electrical line segment 122*e*. A metallic barrel 204 is electrically coupled to the crimp 202 and defines a socket for receiving one end of a female connector 206. In the illustrated embodiment, the female connector 206 is formed of an electrically conductive material such as metal while the removable block 200 is formed of a non-conductive polymer that is molded over the female connector 206. As a result, the female connector 206 is fixed to and moves in conjunction with the block 200. It should be understood that although one set including the electrical line segment 122*e*, the wire crimp 202, the metallic barrel 204 and the female connector 206 has been discussed in details, the connector 104 may comprise a plurality of identical sets, for example disposed according to the pattern shown in FIG. 5. The connector 104 is therefore capable of connecting a plurality of electrical line segments. Also, the connector 104 is not limited a plurality of identical or similar means for connecting electrical line segment. It should be appreciated that various designs of means for connecting electrical line segment may be used in one connector, for example in order to accommodate different amperages or voltages carried by each of the plurality of electrical line segments. A reinforcing ring 208 formed of a durable material such as metal is disposed in an annular recess formed in an exterior of the block 200. The reinforcing ring 208 facilitates insertion of a tool to assist in removing the block 200 from the housing 170 for replacement as will be discussed in greater detail below. The block 200 may further include a recess 210 sized to receive a scraper seal, such as an o-ring 212. A retaining plate 214 is coupled to the block 200 for holding the o-ring 212 in the recess 210.

Tuning back to FIG. 3, the hydraulic module 116 also includes a housing 220 having a female connection end 222 sized to slidably receive the male connection end 172 of the probe module 118. A bulkhead 224, made of non corrosive alloy, such as nickel based or titanium based alloy for example, is coupled to the housing 220 and defines a connection face 226 adapted to interface with the connection face 192 of the probe module 118. Fluid flow lines 228, 230 extend through the bulkhead 224 and are sized to receive hydraulic stabbers 232, 234, respectively. For example, hydraulic stabbers 232, 234 may be threaded to the bulkhead 224. Distal ends of the stabbers 232, 234 are sized for insertion into the receptacles 188, 190, respectively, defined by the fluid conduits 180, 182. More details of stabbers 232, 234 will be discussed in FIGS. 9A and 9B, and have been omitted in FIG. 2 for clarity. As mentioned before, only two flow lines are visible in the cross section shown in FIG. 2. However, the other two flow lines (not shown) are located in front of and behind the section plane. Continuing with the example, the flow line 230 may be fluidly connected to the flow line 136, and the flow line 232 may be fluidly connected to the flow line 144.

Figure 4:
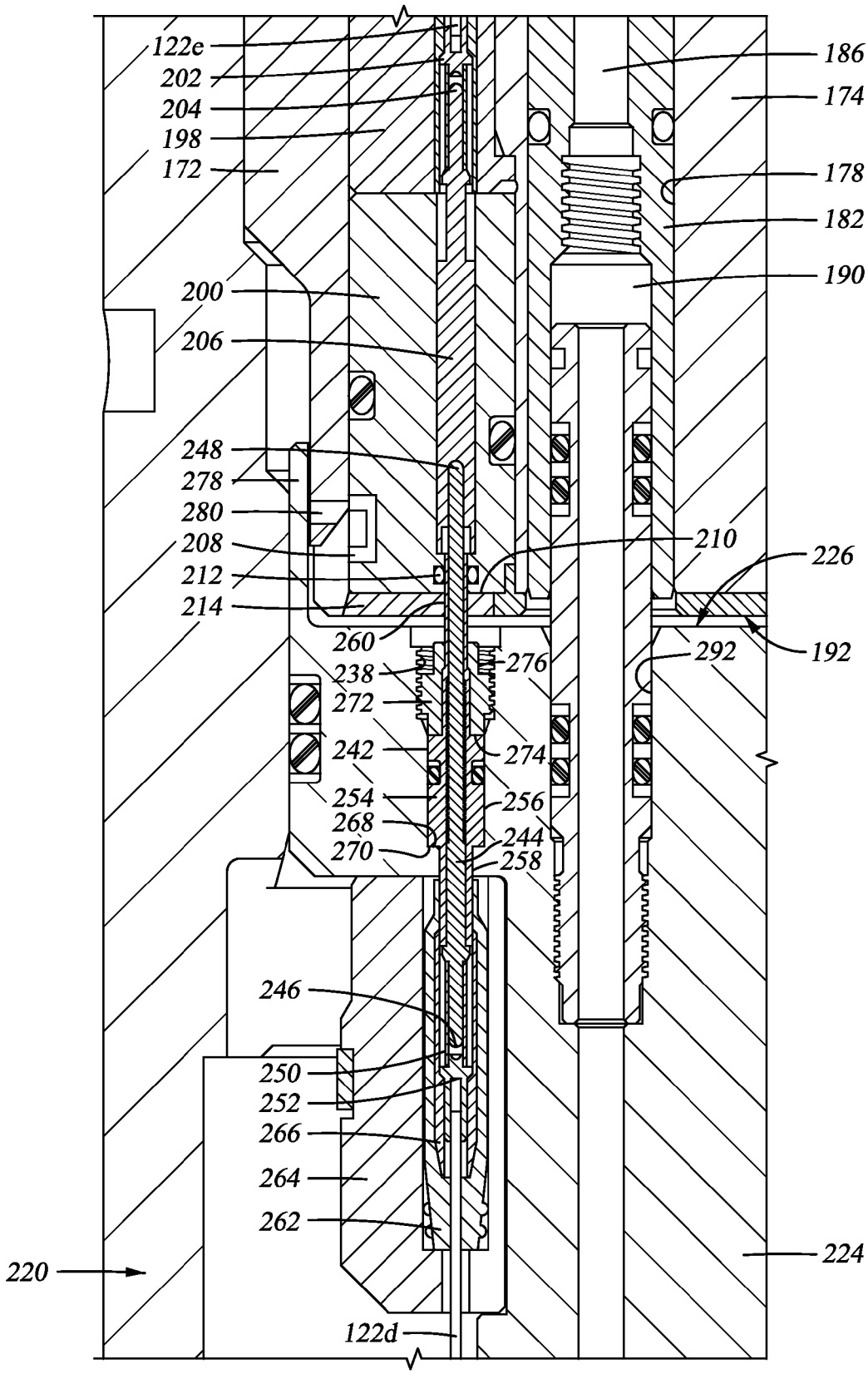
FIG. 4 is an enlarged detail of the field joint of FIG. 3.

The bulkhead 224 further includes conduit at east one feedthrough hole 238 which may be adapted to receive male electrical connector assemblies 242. As best shown in FIG. 4, the male electrical connector assembly 242 may include a male connector configured to engage an associated female connector 206. In the illustrated embodiment, the male connector is a feedthrough 244 having a proximal end 246 disposed within the housing 220 and a distal end 248 projecting outwardly from the bulkhead connection face 226. The bulkhead 224 includes an annular wall 278 projecting outwardly from the connection face 226 to protect the male connector distal end 248 from inadvertent damage during handling. When the modules are connected, the male connector distal end 248 contacts the female connector 206, thereby electrically connecting the two modules. The male connector proximal end 246 is received in a metallic barrel 250 electrically connected to a crimp 252. The electrical line segment 122*d* has an exposed end that is coupled to the crimp 252. Accordingly, when the modules are assembled, the male and female electrical connector assemblies electrically couple the electrical line segments 122*d*, 122*e*, thereby transferring electronic signals between the modules. Again, it should be understood that although one set including the electrical line segment 122*d*, the wire crimp 252, the metallic barrel 250 and the feedthrough 244 has been discussed in details, the connector 104 may comprise a plurality of identical sets, for example disposed according to the pattern shown in FIG. 5. As mentioned before, the connector 104 is not limited a plurality of identical or similar means for connecting electrical line segment. It should be appreciated that various designs of means for connecting electrical line segment may be used in one connector, for example in order to accommodate different amperages or voltages carried by each of the plurality of electrical line segments.

The male and female electrical connector assemblies employ several measures to isolate the electrical line 122 from surrounding, electrically conductive structures (i.e.

other electrical connections, metallic bodies, etc). As noted above, the removable connector block 200, and the stationary block 198 are preferably formed of a non-conductive polymer that is molded directly onto the female connector 206 thereby isolating the female connector 206 from the housing 170 and the transition block 174.

In addition, the male electrical connector assembly 242 may include an insulating sleeve 254 that extends over a central portion of the male connector 244. As best shown in FIG. 4, the insulating sleeve 254 includes a larger diameter central region 256, a smaller diameter proximal region 258 extending axially rearwardly from the central region 256, and a smaller diameter distal region 260 extending axially forwardly from the central region 256. The distal region 260 preferably projects sufficiently away from the connection face 226 to extend at least partially into the removable connector block 200, but does not cover the male connector distal end 248 so that the end 248 may contact the female connector 206. The proximal region 258 of the insulating sleeve 254 preferably extends through the feedthrough hole 238 and terminates adjacent to the barrel 250. The insulating sleeve 254 is preferably formed of a non-conductive polymer material to isolate the male connector 244 from the bulkhead 224 and other metallic, electrically conductive surrounding structures.

The male connector proximal end 246 may be shielded from damage by a boot 262. The boot is disposed in a boot holder 264 that is coupled to the bulkhead 224. An insulating jacket 266 is disposed between the boot 262 and the male connector distal end 246, barrel 250, and crimp 252 thereby electrically isolating the electrical line 122 from surrounding structures. Accordingly, the insulating jacket 266 is preferably formed of a non-conductive polymer material.

The o-ring 212 further insures that electrical contact is made between the male connector 244 and the female connector 206 by serving as a scrapper seal that removes contamination from the male connector 244 as it is inserted into the female connector 206. As best shown in FIG. 4, the o-ring 212 is positioned in the recess 210 which is located at an entrance to the chamber that houses the female connector 206. The o-ring 212 preferably has an inner diameter sized to slidingly engage the male connector 244. Accordingly, as the connection faces 192, 226 are joined, the male connector 244 slides through the o-ring 212 which removes fluid contaminants from an exterior surface of the male connector distal end 248. Consequently, the male and female 244, 206 are more reliably placed in an electrically conductive contact. Electrical contact may be further enhanced by introducing grease in the female connector 206 prior to join the connection faces 192 and 266. The grease may act as an electrical insulator and thereby may prevent short circuit between two pins or between a pin and the mass (e.g. the tool housing).

The male electrical connector assemblies may be removably attached to the bulkhead 224 from an exterior of the connection face 226 thereby facilitating repair and replacement, such as when the male connector 244 is worn or accidentally bent. In the illustrated embodiment, the feedthrough hole 238 includes a base flange 268 that is sized to engage a first shoulder 270 formed by the insulating sleeve 254. The insulating sleeve central region 256 is sized to slidingly engage the feedthrough hole 238 until the first shoulder 270 engages the base flange 268, thereby preventing further movement of the male electrical connector assembly 242 into the bulkhead 224. A plug 272, for example formed of metal, is configured to engage a second shoulder 274 of the insulating sleeve 254 and is further configured to releaseably engage the conduit aperture 238, thereby retaining the insulating sleeve 254 and attached male connector 244 within the feedthrough hole 238. As shown in FIG. 4, the plug 272 includes a central passage sized to receive the insulating sleeve distal region 260. The conduit aperture 238 may include a threaded section, and the plug 272 may include complementary external threads to facilitate releasable engagement therebetween. The plug 272 further includes a reduced diameter end 276 which creates a generally annular gap into which a tool may be placed to facilitate attachment and disconnection of the plug 272. Accordingly, the male connector 244 may be replaced by unscrewing the plug 272 and grasping the male connector distal end 248 to pull the male electrical connector assembly 242 out of the conduit aperture 238. During this process, the barrel 250, crimp 252 and electrical line segment 122*d* remain stationary within the boot 262.

Figure 8A:
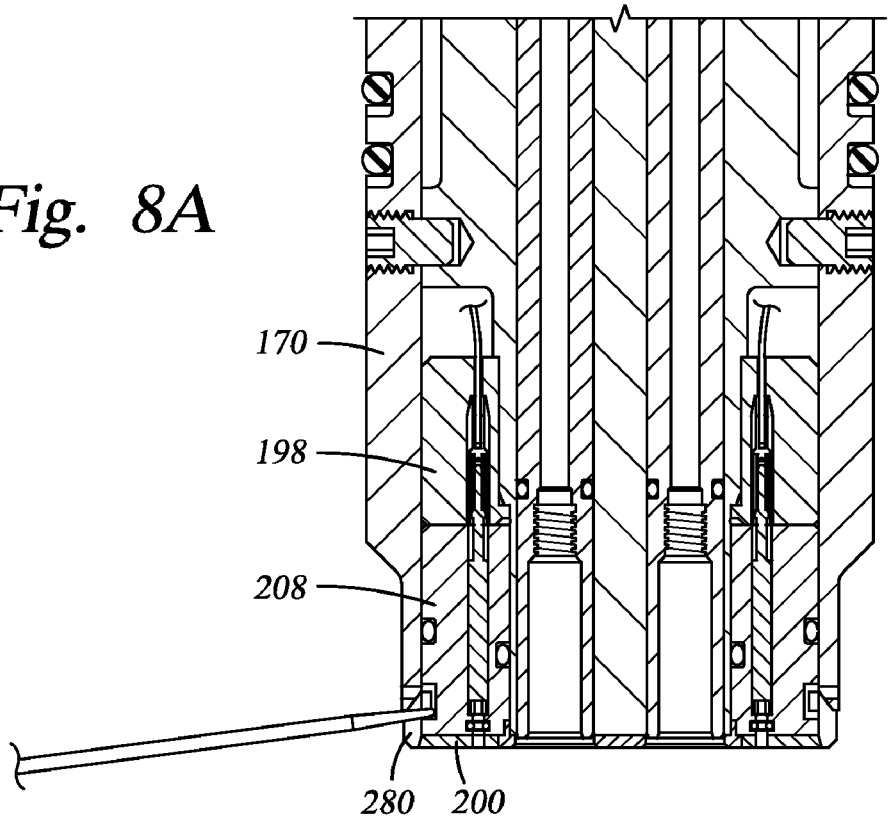
FIGS. 8*a* and 8*b* are schematic views of a connector block used to form a second connection face of the field joint in normal and displaced positions, respectively.
Figure 8B:
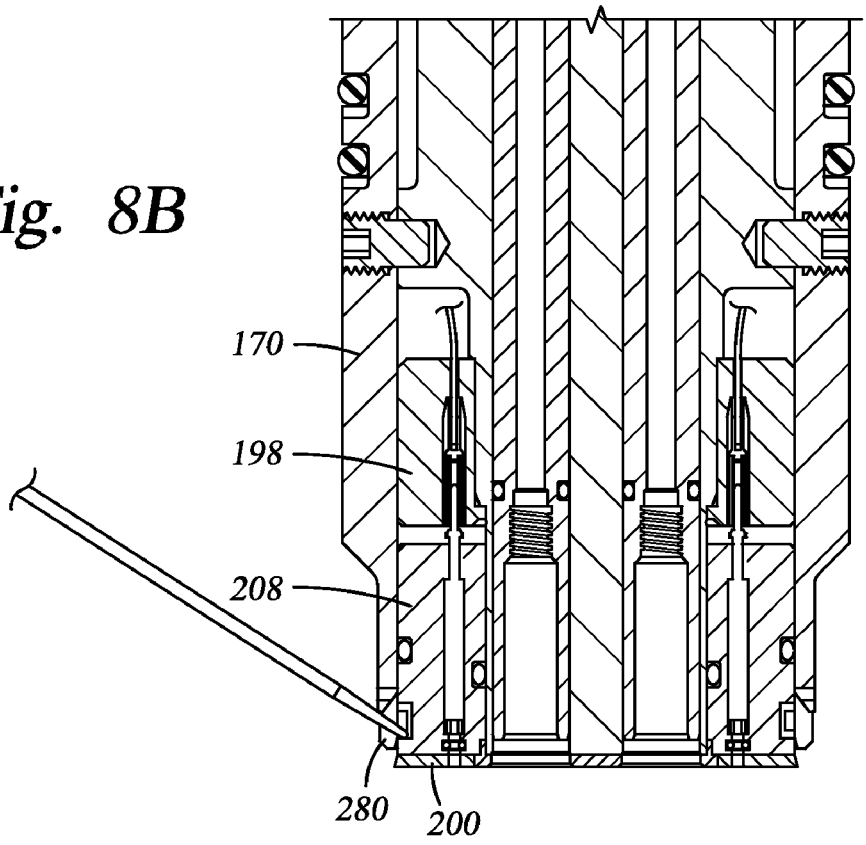

The female connector 206 is also removable for replacement in the event of fluid contamination or other damage. The removable block 200 is frictionally held in position between the housing 170 and transition block 174. A pair of slots 280 is formed in the housing male end 172 to allow insertion of a prying tool, such as a flathead screwdriver, into the reinforcing ring 208 attached to the removable block 200. The slots 280 are preferably positioned on diametrically opposed portions of the housing 170 so that the annular shaped block 200 may be slowly manipulated out of the housing by applying prying force to the slots in an alternating fashion. The slots 280 and reinforcing ring 208 are schematically illustrated in FIGS. 8*a* and 8*b*. FIG. 8*a* illustrates the removable block 200 in a normal position, while FIG. 8*b* shows the block 200 in a partially displaced position, with the removable block 200 moved away from the stationary block 198 and partially removed from the housing 170.

Figure 5:
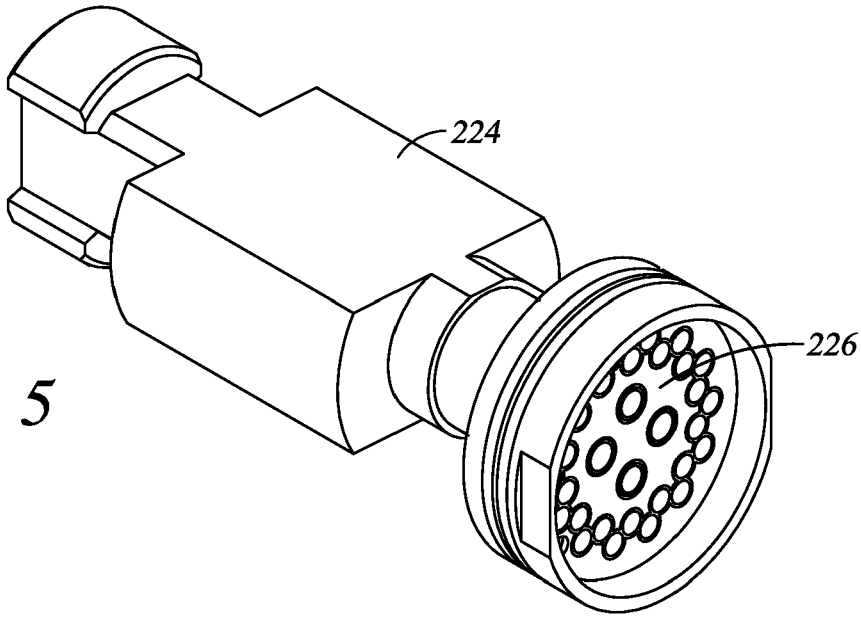
FIG. 5 is perspective view of a bulkhead provided with a tool module to define a connection face of the field joint.
Figure 6:
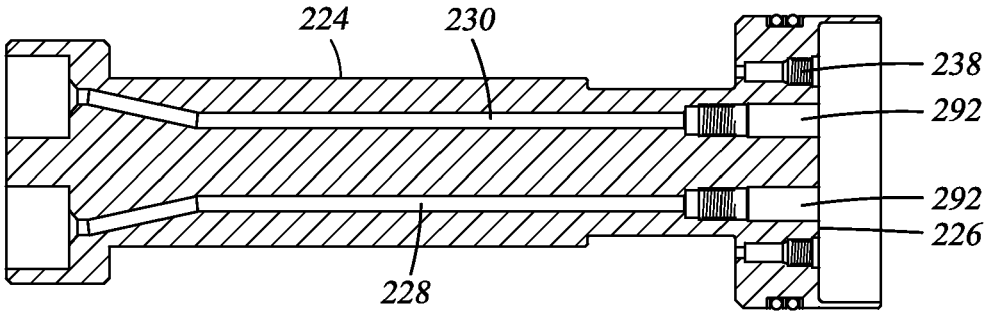
FIG. 6 is a side elevation view, in cross-section, of the bulkhead shown in FIG. 5.
Figure 7:
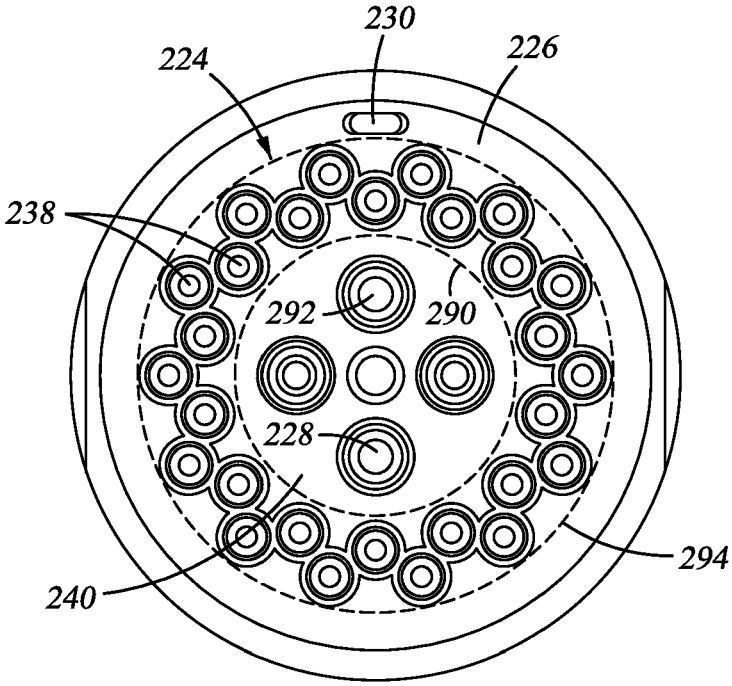
FIG. 7 is an end view of the bulkhead shown in FIG. 5.

FIGS. 5-7 provide additional views of the bulkhead 224. The bulkhead 224 defines the connection face 226 which carries the fluid and electrical connections for the tool module. As best shown in FIG. 7, the connection face 226 includes a central region 290 in which conduit apertures 292 are disposed. In the described example, the conduit apertures 292 are in fluid communication with the flow lines 136, 144, 132 and 134 from the hydraulic module 116 respectively (FIG. 2). As mentioned before, the four conduit aperture may be in fluid communication with flow lines conducting either auxiliary fluid, hydraulic fluid for actuating or cooling a tool component, or a combination. The four conduit apertures are not restricted to the example shown in FIG. 2. As shown, the four conduit apertures 292 are configured for receiving the hydraulic stabbers 232, 234 shown in FIGS. 3 and 4, as well two other similar stabbers for example. The central region can vary in size, but in this exemplary embodiment is defined by a diameter having approximate size of 1.7 inches. A peripheral region 294 surrounds the central region and includes multiple feedthrough holes 238. The peripheral region may also vary in size, and in this exemplary embodiment is defined by an annulus constrained by a diameter larger than the one of the central region and an outer diameter having approximate size of 3.0 inches. The layout of the connection face 226 provides physical spacing between the conduit apertures 292 and the electrical connectors 244 (not shown on FIG. 5, 6, or 7) assembled in the feedthrough holes 238, and also promotes electrical isolation between the multiple electrical connectors themselves. By grouping the conduit apertures 292 within the central region 290, the connection face 226 may include an isolation band 240 with no connector that separates the conduit apertures 292 from the electrical connectors 244, thereby reducing the likelihood of fluid reaching the electrical connectors 244. Additionally, by placing the feedthrough holes 238 around a periphery of the connection face 226, the spacing between adjacent electrical connectors may be maximized, thereby decreasing the risk of electrical shorting therebetween. Furthermore, higher electrical power may be applied to the different electrical connectors 244 as a result of the added insulation provided by the greater spacing. By arranging the feedthrough hole 238 in this fashion, the spacing between adjacent connectors 244 may be as much as 0.25 inches in the shown embodiment. Those skilled in the art will appreciate that this spacing could be increased by reducing the number of electrical connections (28 in the shown embodiment).

Figure 9A:
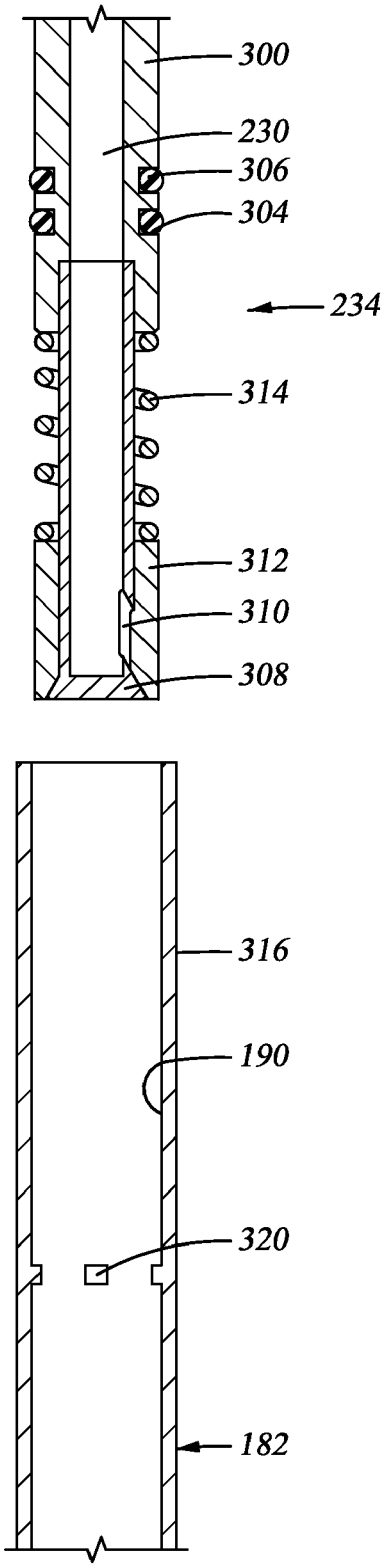
FIGS. 9*a* and 9*b* are schematic views of a fluid line stabber assembly in the disconnected and connected positions, respectively.
Figure 9B:
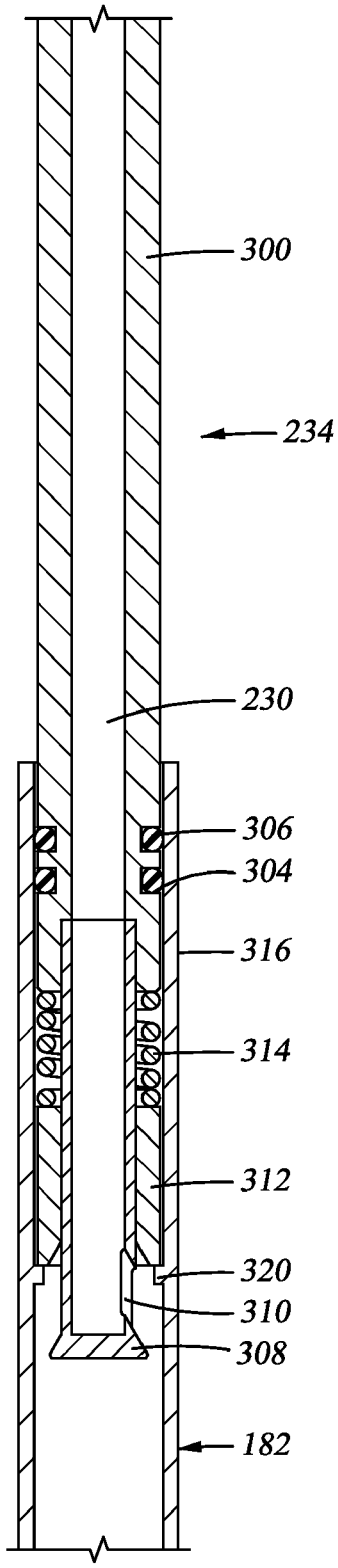

The field joints 104 may also include self-sealing stabbers to further limit inadvertent discharge of fluid when the modules are disassembled after use. It should be appreciated that the self-sealing stabbers may be used on any flow line, including flow line conducting auxiliary "dirty" fluids such as formation fluid or wellbore fluid. Indeed, these fluids may contain particle in suspension that tend to clog the connection at self-sealing stabber. As best shown in FIGS. 9*a* and 9*b*, the stabber 234 may, for example, include a housing 300 defining a fluid flow passage 230. An exterior of the housing 300 is formed with an annular channel 304 sized to receive o-rings 306 configured to seal between the housing 300 and the receptacle 190 located at a distal end of the flow line. The housing 300 includes a connection end 308 defining at least one flow aperture 310, and preferably 3 flow apertures evenly disposed about the circumference of the housing 300 (not visible in the cross sections of FIGS. 9*a* and 9*b*. Using a plurality of flow aperture may prevent clogging the connection at the level of the valve, in contrast to the self-sealing stabbers of the prior art.

A valve element, such as valve sleeve 312, slidingly engages an exterior surface of the housing connection end 308 and is movable between a closed position in which the sleeve 312 prevents fluid flow through the aperture 310 as shown in FIG. 9*a*, and an open position in which the sleeve exposes at least a portion of the flow aperture 310 to allow fluid flow. A resilient member, such as spring 314, extends between the housing 300 and the sleeve 312 to bias the sleeve 312 toward the closed position.

The fluid flow conduit 182 extending through the transition block 174 of the other module has a receiving end 316 defining a receptacle 190 sized to receive the connection end 308. The receiving end 316 further includes an inwardly projecting shoulder 320 that is sized to engage the valve sleeve 312 while permitting the housing connection end 308 to pass through. Accordingly, as the housing 300 is inserted into the receptacle 318, the shoulder 320 eventually prevents further insertion of the sleeve 312 while permitting the housing 300 to move relatively thereto, thereby moving the sleeve valve 312 to the open position as shown in FIG. 9*b*. Subsequently, when the housing 300 is withdrawn from the receptacle 318, the spring 314 automatically returns the sleeve valve 312 to the closed position, thereby preventing the inadvertent and uncontrolled discharge of fluid from the conduit fluid flow passage 230. It should be noted that the shoulder 320 spans over a limited portion of the circumference of the valve sleeve 312. Using a shoulder that engages a small portion of the valve sleeve may prevent clogging the connection at the level of the valve. Also, it should be noted that in the open position, the shoulder 320 is disposed as to not interfere significantly with the flow of fluid coming out of the aperture(s) 310. Using a shoulder that in the open position of the valve is located beyond the apertures may also may prevent clogging the connection at the level of the valve. It should be noted that although a self sealing stabber has been described with respect to stabber 234, the fluid connector 104 can include up to four self sealing stabbers in the shown configuration.

While only certain embodiments have been set forth, alternatives and modifications will be apparent from the above description to those skilled in the art. In particular, the fluid connector 104 has been described with respect to a testing tool conveyed downhole with a wireline cable. However, a similar testing tool, including the connector of the present disclosure may be conveyed downhole on a work string capable of being rotated with a rotary located on the surface rig 100 (FIG. 1). Further, the connector of the present disclosure may be used in a drilling environment. The connector 104 may be configured for connecting chassis modules together. These chassis modules may be inserted in the bore of one or more drill collars, leaving an annular space for the circulation of drilling fluid towards the bit. At least one chassis module is coupled to a probe capable of being projected outside of a drill collar. Also, the location of one or more of the male and female parts of the hydraulic or electrical connection may be swapped between connecting faces. In addition, the connector of the present invention can be scaled up or down in size, and may accommodate respectively a larger or lower number of independents fluid or electrical connections. Further, the number of connections may be decreased while keeping the size of the connector essentially identical. These and other alternatives are considered equivalents and within the spirit and scope of this disclosure and the appended claims.

What is claimed is:

1. An apparatus, comprising:

a plurality of modules collectively configured to be positioned within a wellbore penetrating a subterranean formation;

a first auxiliary line extending through the plurality of modules;

a second auxiliary line extending through the plurality of modules;

a first hydraulic line extending through the plurality of modules; and a second hydraulic line extending through the plurality of modules;

wherein the plurality of modules comprises:

a first module comprising:

a displacement system;

a first portion of the first auxiliary line;

a first portion of the second auxiliary line;

a first portion of the first hydraulic line;

a first portion of the second hydraulic line; and a hydraulic pump fluidly configured to drive the displacement system via receiving, at least indirectly, hydraulic fluid from the first portion of the first hydraulic line and returning, at least indirectly, hydraulic fluid to the first portion of the second hydraulic line;

a second module comprising:

a second portion of the first auxiliary line;

a second portion of the second auxiliary line;

a second portion of the first hydraulic line;

a second portion of the second hydraulic line;

a first inlet configured to transmit virgin formation fluid from the formation into the second portion of the first auxiliary line via operation of the displacement system;

a second inlet configured to transmit contaminated formation fluid from the formation into the second portion of the second auxiliary line via operation of the displacement system; and a setting piston operated via communication with the second portion of the first hydraulic line and the second portion of the second hydraulic line;

a connector disposed between the first and second modules and comprising:

a first hydraulic line connection fluidly coupling the first and second portions of the first hydraulic line;

a second hydraulic line connection fluidly coupling the first and second portions of the second hydraulic line;

a first auxiliary line connection fluidly coupling the first and second portions of the first auxiliary line; and a second auxiliary line connection fluidly coupling the first and second portions of the second auxiliary line.

2. The apparatus of claim 1 further comprising:

a first electrical line extending through the plurality of modules; and a second electrical line extending through the plurality of modules;

wherein the first module comprises a first portion of the first electrical line and a first portion of the second electrical line;

wherein the second module comprises a second portion of the first electrical line and a second portion of the second electrical line;

wherein the connector further comprises a first electrical line connection communicably coupling the first and second portions of the first electrical line; and wherein the connector further comprises a second electrical line connection communicably coupling the first and second portions of the second electrical line.

3. The apparatus of claim 2 wherein the plurality of modules further comprises a third module comprising:

a third portion of the first electrical line;

a third portion of the second electrical line; and an electrical controller communicably coupled to the third portions of first and second electrical lines.

4. The apparatus of claim 3 wherein the third module further comprises:

a third portion of the first auxiliary line;

a third portion of the second auxiliary line;

a third portion of the first hydraulic line; and a third portion of the second hydraulic line.

* * * * *